US008596957B2

(12) United States Patent
Seebauer

(10) Patent No.: US 8,596,957 B2
(45) Date of Patent: Dec. 3, 2013

(54) FAN WITH INTEGRATED REGULATION VALVE

(75) Inventor: Manfred Seebauer, Aveiro (PT)

(73) Assignee: EBM-PAPST Landshut GmbH, Landshut (DE)

( * ) Notice: Subject to any disclaimer, the term of this patent is extended or adjusted under 35 U.S.C. 154(b) by 783 days.

(21) Appl. No.: 12/682,654

(22) PCT Filed: Jun. 30, 2008

(86) PCT No.: PCT/EP2008/005322
§ 371 (c)(1),
(2), (4) Date: Apr. 12, 2010

(87) PCT Pub. No.: WO2009/049694
PCT Pub. Date: Apr. 23, 2009

(65) Prior Publication Data

US 2010/0269931 A1 Oct. 28, 2010

(30) Foreign Application Priority Data

Oct. 12, 2007 (EP) ..... 07020007

(51) Int. Cl.
*F04D 1/00* (2006.01)

(52) U.S. Cl.
USPC ..... 415/29; 415/150

(58) Field of Classification Search
USPC ..... 415/27, 28, 29, 39, 144, 145, 150
See application file for complete search history.

(56) References Cited

U.S. PATENT DOCUMENTS

| | | | | |
|---|---|---|---|---|
| 2,596,646 | A * | 5/1952 | Buchi | 415/204 |
| 5,401,162 | A * | 3/1995 | Bonne | 431/12 |
| 5,989,014 | A * | 11/1999 | Invernizzi | 431/328 |
| 6,247,919 | B1 * | 6/2001 | Welz et al. | 431/13 |
| 6,537,060 | B2 * | 3/2003 | Vegter | 431/90 |
| 6,674,199 | B2 * | 1/2004 | Long | 310/89 |
| 7,252,482 | B2 * | 8/2007 | Walker et al. | 417/40 |
| 2001/0002595 | A1 * | 6/2001 | Pappalardo et al. | 137/65 |
| 2004/0237947 | A1 * | 12/2004 | Strohle | 123/527 |
| 2005/0095121 | A1 * | 5/2005 | Vithani | 415/121.2 |
| 2006/0213560 | A1 * | 9/2006 | Invernizzi | 137/455 |
| 2006/0292505 | A1 * | 12/2006 | Giacomelli | 431/12 |
| 2007/0243496 | A1 * | 10/2007 | Thiewes et al. | 431/354 |
| 2010/0269931 | A1 * | 10/2010 | Seebauer | 137/565.11 |

FOREIGN PATENT DOCUMENTS

| | | | |
|---|---|---|---|
| DE | 3011287 | A * | 10/1981 |
| DE | 19729047 | C1 | 9/1998 |
| DE | 10161842 | A1 | 6/2003 |

(Continued)

OTHER PUBLICATIONS

Search Report and Written Opinion from corresponding PCT Application No. PCT/EP2008/005322 dated Oct. 10, 2008.

(Continued)

*Primary Examiner* — Edward Look
*Assistant Examiner* — Christopher R Legendre
(74) *Attorney, Agent, or Firm* — Harness, Dickey & Pierce, P.L.C.

(57) ABSTRACT

A radial fan, in particular for a gas burner, for premixing air and gas, comprising a housing with a radial fan wheel disposed therein, and a regulation valve for regulating a gas volume, which comprises a valve seat, wherein the valve seat of the regulation valve is formed by a portion of the housing.

22 Claims, 5 Drawing Sheets

(56) References Cited

FOREIGN PATENT DOCUMENTS

| | | | |
|---|---|---|---|
| DE | 102004007123 | B3 | 8/2005 |
| EP | 0 834 695 | A | 4/1998 |
| EP | 0 834 695 | A1 | 4/1998 |
| EP | 1 243 857 | A1 | 9/2002 |
| WO | WO 2007/098790 | A1 | 9/2007 |

OTHER PUBLICATIONS

Search Report and Written Opinion dated May 20, 2010 in corresponding PCT Application No. PCT/EP2008/005322.

* cited by examiner

FAN WITH INTEGRATED REGULATION VALVE

CROSS-REFERENCE TO RELATED APPLICATIONS

This application is a 371 U.S. National Stage of International Application No. PCT/EP2008/005322, filed Jun. 30, 2008. This application claims the benefit of European Patent Application No. EP 07020007.6, filed Oct. 12, 2007. The disclosures of the above applications are incorporated herein by reference.

FIELD OF THE INVENTION

The invention relates to a fan, in particular for a gas burner for premixing gas and air, including a housing with a regulation valve for regulating the gas volume, which includes a valve seat, wherein the valve seat of the regulation valve is formed by a portion of the housing.

INTRODUCTION

It is known to use gas heater fans for premixing gas and air for gas burners, wherein an air ratio Lambda of 1.3 is desirable. For safety reasons, it is required as a standard that the provision of the gas is secured by at least two safety valves of the classes C and B against a possible gas leakage. In order to comply with these safety requirements, and in order to regulate the required gas volume, typically, combination gas regulators are being used, which include the required safety valves for cutting off the gas supply when the heat requirement is terminated or when the flame of the gas burner is extinguished, and which also include the regulation valve required for regulating the gas volume. The combination gas regulators are often connected as additional components in front of the fan, wherein the combination gas regulator provides a connection to the fan, which mixes the aspirated air with the supplied gas and feeds the mix to the gas burner.

A mixing apparatus for fan-augmented gas burners is known from DE 101 61 842 A1, wherein the fan and the combination gas regulator are disposed in a common housing. This achieves the advantage that the mixing of the gas volume required for combustion is performed directly at the fan rotor. However, it is an advantage of this configuration that at least the gas supplying portion of the common housing has to be provided gas tight according to the EN161 Standard. Typically, the housings for gas heater fans are produced through pressure die casting. Producing a gas tight die cast housing, however, causes additional expense and complexity. Alternatively, an additional gasket for the housing would have to be provided, so that gas leakage is prevented for sure. It is furthermore disadvantageous for the illustrated embodiment that an integration of a fan and a combination gas regulator in one housing causes complex production and test processes. Also, when service is required, the known solution has substantial disadvantages, since the combination gas regulator also has to be replaced when the fan fails. Accordingly, the fan also has to be replaced when the combination gas regulator fails. In both cases, this causes substantial expense.

DE 197 29 047 C1 discloses a mixing apparatus for generating a mix made of gas and combustion air for a burner. A mixing apparatus of this type is furthermore disclosed in DE 10 2004 007 123 B3. For the known mixing apparatuses recited supra, gas is introduced into a mixing chamber, which is flowed through by the airflow of an externally disposed fan. The admixture or the mixing of the gas is thus either performed through an annular gap or through a venturi nozzle. The illustrated mixing apparatuses are provided as additional components besides the gas burner and the fan and assure thorough mixing at the desired gas/air ratio. It is a disadvantage of the illustrated mixing apparatuses that an additional component has to be provided for mixing air and gas, by means of which gas and combustion air shall be mixed at the right ratio. This requires a lot of space, on the one hand; on the other hand, additional expense is caused by respective additional components, like a mixing chamber. When the distance or the volume to the gas burner is large, this can also generate a long lag period. Thus, lag period means the amount of time that elapses until sufficient gas is supplied to the gas heater after a period of inactivity.

BRIEF SUMMARY OF THE INVENTION

Thus, it is the object of the invention to provide a fan with brief lag time, which is compact and can be produced cost effectively.

The fan according to the invention comprises a housing with a gas supply and a regulation valve for regulating the gas volume. The regulation valve comprises a valve seat which is formed by a portion of the housing. This assures advantageously that the lag period until the desired gas volume is supplied is very short, and that the installation height for the entire assembly is significantly reduced. The regulation valve itself does not have to be gas tight. Safety against gas leakage can be exclusively provided by one or several safety apparatuses outside of the housing or at the outside of the fan housing.

In alternative embodiments of the invention, the valve seat can also be configured in the interior of the housing or at the outer surface of the housing.

It is also advantageous to use gas safety valves, which comply with the standards recited supra, as a safety apparatuses against gas leakage. Depending on the configuration and class of the gas safety valve, one or more of these valves can be provided.

In an advantageous embodiment, the regulation valve can include a valve seat and a valve body. In a particularly preferred embodiment of a valve body, a valve cone can be used that interacts accordingly with a respective valve seat. The valve seat can thus be provided e.g. as a funnel shaped depression with a centrally disposed pass-through opening. In order to achieve the required tolerances, the housing is advantageously configured as a die cast component, wherein the valve seat at the housing is also produced through the casting process, preferably without machining. Since there are no requirements for the valve seat with respect to gas tightness, die cast quality is sufficient for the surface. Additional finishing steps can thus be omitted.

In a preferred embodiment, the regulation valve includes a control apparatus, through which the valve body can be moved relative to the valve seat. As an advantageous variant, thus a stepper motor is suitable for control apparatus.

In an advantageous embodiment, it can be provided that an inlet cavity is configured between the control apparatus and the valve seat, which inlet cavity can have a gas outlet towards the radial fan wheel. The valve body can move axially in the inlet cavity and can thus determine the extent by which the regulation valve is opened. Based on the advantageous disposition of the regulation valve with a valve seat directly at the housing, only very short flow paths of the gas need to be covered, and the gas can be introduced through the inlet cavity directly to the fan wheel in order to be mixed with air.

Based on the configuration of the fan according to the invention, it is furthermore advantageous when the opening position of the regulation valve can be pre-adjusted in a standby phase of the fan for a subsequent operating phase. When the fan according to the invention is used for gas burners, an optimization of the ignition properties can be achieved for the next activation of the gas burner through an optimum setting of the regulation valve. This is particularly advantageous, since it can thus be assured that the activation of the gas burner, which occurs subsequent to the standby condition, is performed under optimum ignition conditions. For gas burners with premixing fans, this can be of particular importance, since their ignition range is substantially smaller than the ignition range of atmospheric burners.

In an alternative embodiment, it is also possible that the control apparatus of the regulation valve is disposed at the outside of the housing in a split tube or in an additional protective housing disposed on the outside of the housing, and sealed against gas egress. The protective housing can either be formed as a die cast component like the housing, or it can be formed as a cast component, or it can be formed from plastic material. This provides a solution with a simple cost effective design that is easy to maintain with respect to the disposition of the regulation valve at the housing.

For a disposition of the regulation valve integrated at the housing, the electric conductor leading to the control apparatus is sealed against gas leakage. The sealing of the electric conductor configured as a regular cable can e.g. be provided through silicone encasement. It is further advantageous for a configuration according to the invention that the control apparatus can be electronically controlled through a bus. Thus, it is advantageous in particular that the bus to the gas burner can also be used for data transmission for the fan and the stepper motor. It is also advantageous that the control of the fan and the control or regulation of the regulation valve can be performed through a single circuit board. The microcomputer receives the commands for the control apparatus (stepper motor) through the bus, which controls the electronics.

In an advantageous embodiment of the invention, the control apparatus can be attached to the housing without additional fasteners. Thus, it is advantageous that a simple attachment can be performed without additional fasteners like bolts or similar.

For a configuration according to the invention, the gas supply can be disposed in a preferred embodiment directly at the gas safety valve or the gas safety valves.

Additional embodiments of the invention are subsequently illustrated in more detail together with the description of preferred embodiments of the invention. The illustrations in the subsequent figures are exemplary and schematic. Like components are designated respectively with like numerals in the figures. Furthermore, only elements are illustrated that are relevant for understanding the invention, wherein:

DETAILED DESCRIPTION

Figure 1:
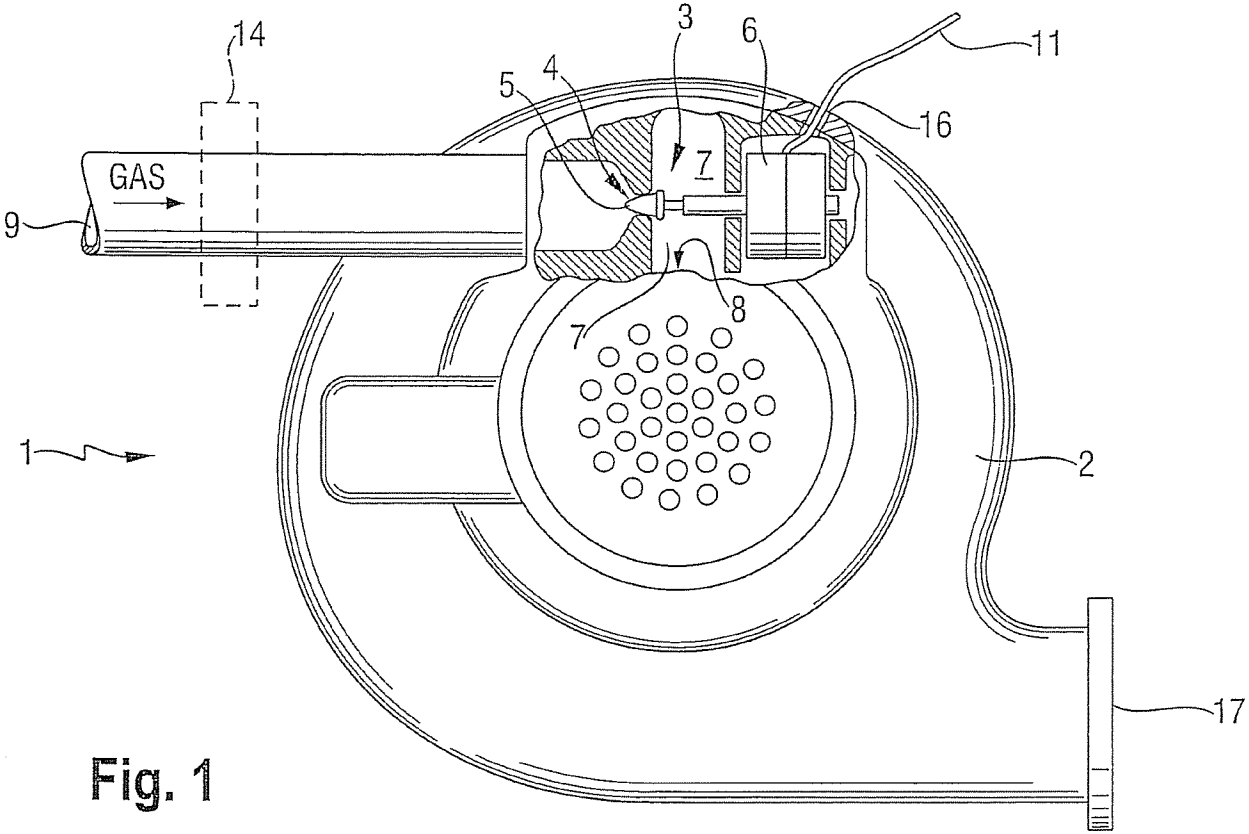
FIG. 1 illustrates a partial sectional side view of the radial fan according to the invention.

FIG. 1 illustrates a radial fan 1 for a gas burner for premixing air and gas in a partial sectional side view. The housing 2 of the radial fan 1 is preferably formed by two complementary covers enclosing a housing cavity. A radial fan wheel is disposed in the interior of the housing, which aspirates ambient air from axially disposed openings, and mixes the ambient air with a gas supplied through a gas connection disposed above the housing 2. This mixture is preferably dispensed to a gas burner through an outlet opening 17 at the housing 2. The gas supply 9 disposed at the housing 2 includes a safety apparatus 14 against gas leakage outside of the housing 2, which safety apparatus is configured, so that all normal requirements are fulfilled, and a safety against gas leakage neither has to be provided by the housing 2, nor by components disposed therein. In order to regulate the desired gas volume, the radial fan 1 includes a regulation valve 3 with a valve seat 4, wherein the valve seat 4 of the regulation valve 3 is formed by a portion of the housing 2. The valve seat 4 is thus formed from die cast material like the housing 2, and does not have to provide tightness relative to the supplied gas. A valve body 5 is provided, which is movable relative to the valve seat 4 in order to regulate the desired gas volume, wherein the valve body 5 is movable through a control apparatus 6 and regulates the inflow volume of the gas as a function of its position. In the illustrated embodiment, the valve body 5 is configured as a valve cone and the valve seat 4 is configured with a shape that is complementary to the valve cone 5, in order to be able to perform a metering of the gas volume, which is as fine as possible, and in particular, also to be able to regulate the very small gas volumes. The control apparatus 6 is preferably configured as a stepper motor and received between the covers of the housing 2 in a respective receiver cavity. The support is thus performed by recesses in the covers of the housing 2. In order to provide power to the control apparatus 6, an electric conductor 11 is provided from the interior of the housing 2 through a passage 16 towards the outside. The passage 16 can be sealed. In a position of the regulation valve 3, where the valve body 5 is offset from the valve seat 4, the gas flows from the gas supply 9 into the inlet cavity 7 that is aspirated by the radial fan wheel through a gas outlet 8, and mixed with the air aspirated by the fan wheel. Preferably, the gas outlet 8 is formed as an annular gap.

Since the regulation valve 3 according to the invention does not have to perform any safety function against gas leakage, it can already be placed into an optimum position for the next activation when the operation of the gas burner is terminated. The optimum position is in particular a function of the ignition properties of the gas burner. The safety function against the gas leakage is exclusively assured by the safety apparatus 14 against gas leakage indicated in the gas supply 9.

Figure 2:
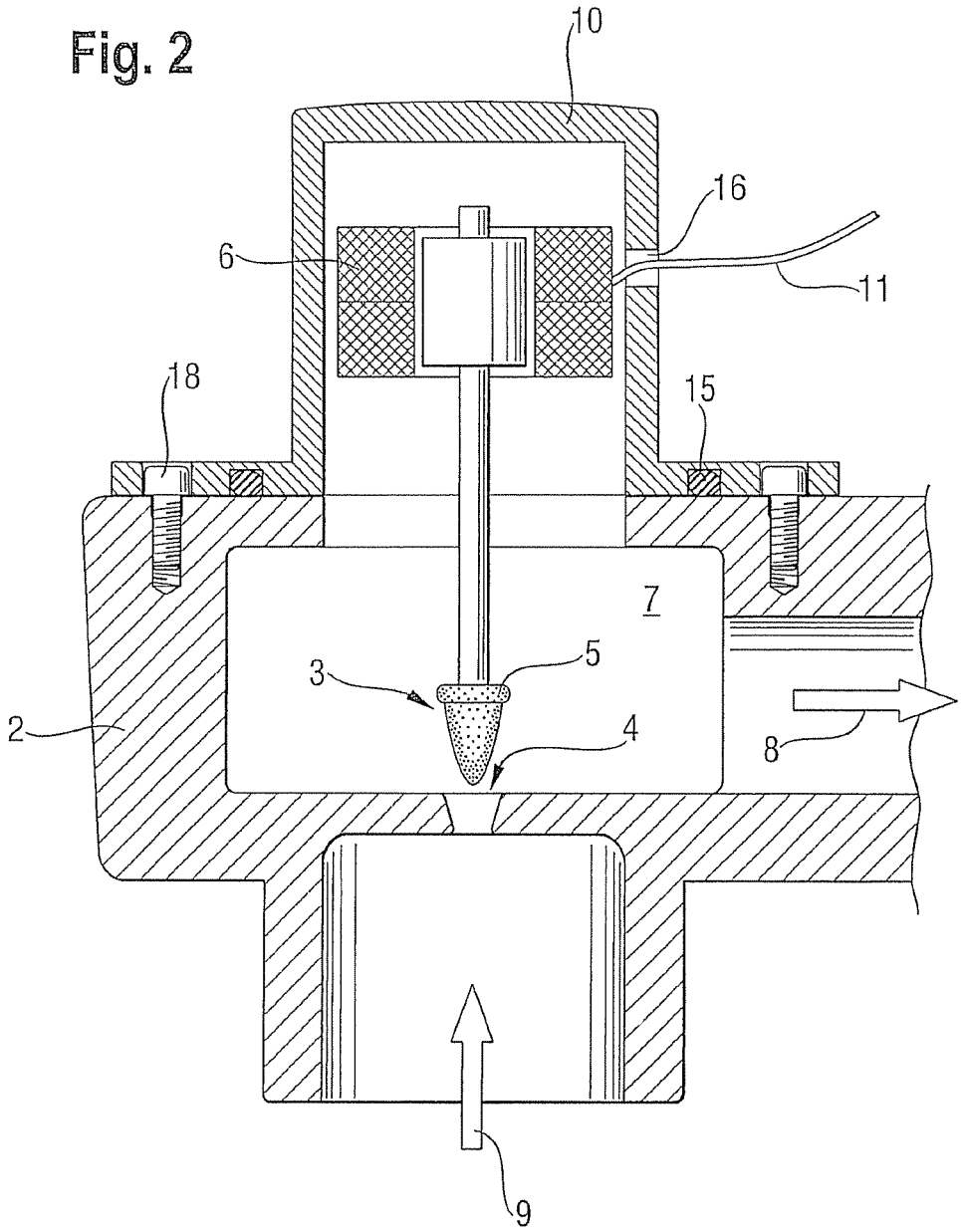
FIG. 2 illustrates a sectional view of a portion of the housing with a protective housing disposed on the outside.

FIG. 2 illustrates a cross sectional view of a portion of the housing 2 with a protective housing 10 attached to its outside. The control apparatus 6 is disposed within the protective housing 10, which control apparatus regulates the position of the valve body 5 relative to the valve seat 4. The protective housing 10 is mounted at the housing 2 through bolts 18 and sealed with seals 15 with respect to gas leakage. The control apparatus 6 is disposed in the gas path. The electric conductor 11 leading to the control apparatus 6 extends through the passage 16 disposed at the protective housing 10, which passage is also sealed with respect to gas leakage. The valve seat 4 is configured in the interior of the housing 2 in the illustrated embodiment, however, the valve seat 4 can also be provided directly at the outer edge of the housing 2. For this purpose, it would only be necessary to shorten the connection between the control apparatus 6 and the valve body 5. The gas outlet 8, which is also disposed in the interior of the housing for the illustrated embodiment, would then also be provided at the outer edge of the housing 2 offset in circumferential direction. Also, in this embodiment, tightness of the valve seat 4 is not necessary, so that the housing preferably made from die cast material provides sufficient surface quality. The protective housing 10 can e.g. be made from cast material, die cast material or plastic material. In an alternative embodiment, components of the regulation valve 3, e.g. the control apparatus 6, can be provided in a slotted tube instead of providing them within a protective housing 10.

Figure 3:
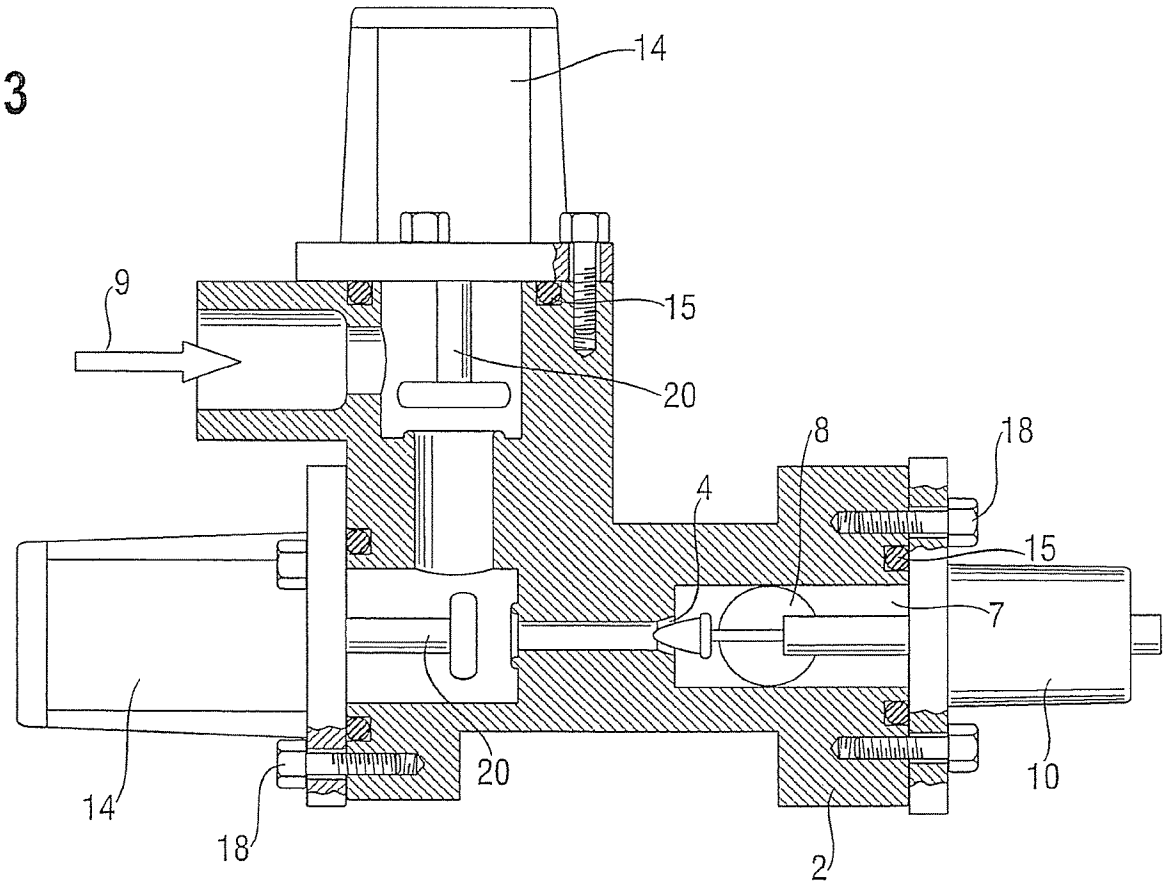
FIG. 3 illustrates a sectional view of a portion of the housing with a safety apparatus against gas leakage disposed thereon.

FIG. 3 illustrates another alternative embodiment for a valve seat 4 configured from a portion of the housing 2 in a sectional view. The gas supply 9 is performed directly into the housing 2, at which e.g. safety apparatuses 14 configured as lift magnets 20 are provided, which safety apparatuses take over the safety against gas leakage completely and exclusively after termination of the operation of the radial fan 1. The gas connection for the gas supply 9 is performed through an inner and an outer thread or through a flange. Compared to the embodiments according to FIG. 1 and FIG. 2, the valve seat 4 of the regulation valve 3 in the embodiment according to FIG. 3 is not aligned in radial direction, but in axial direction of the radial fan wheel. For an opening position of the valve body 5 relative to the valve seat 4 with the gas leakage safety apparatuses 14 open, gas flows into the inlet cavity 7 and further through the gas outlet 8 to the radial fan wheel. The control apparatus 6 for regulating the regulation valve 3 is provided in a protective housing 10 disposed on the outside of the housing 2. This protective housing 10 is bolted to the housing 2 and sealed through seals 15 with respect to gas leakage. In the illustrated embodiment, two safety apparatuses 14 against gas leakage are provided. As long as the requirements of the standard are fulfilled, it can also suffice to provide only one such apparatus. The safety apparatuses 14 against gas leakage are also sealed through seals 15 against gas leakage relative to the housing 2, and attached at the housing 2 through bolts 18.

Figure 4:
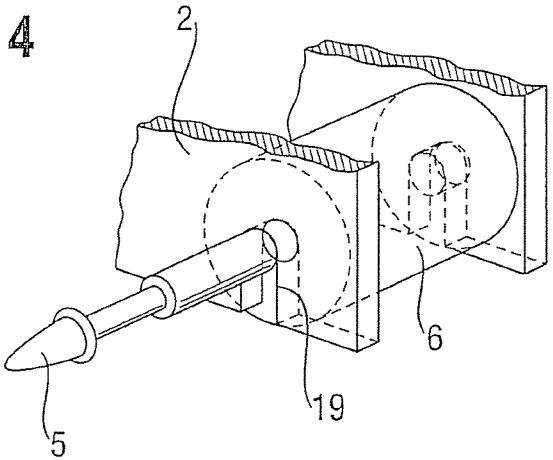
FIG. 4 illustrates a perspective view of the control apparatus.

FIG. 4 illustrates a perspective view of the control apparatus 6 at the housing 2, of which only a small portion is illustrated. In order to receive the control apparatus 6, it is provided that the housing 2 configured from two covers comprises receivers 19, into which the control apparatus 6 can be inserted or fitted. Thus, the control apparatus 6 can be attached in the housing 2 without additional fasteners. The control apparatus 6 can be supported in the receiver 19, in particular through two clips, which are not shown, or through the respective counter piece of the housing 2. The receiver 19 preferably configured as a groove is also considered when producing the associated cover of the housing 2, and thus does not have to be added subsequently.

Figure 5:
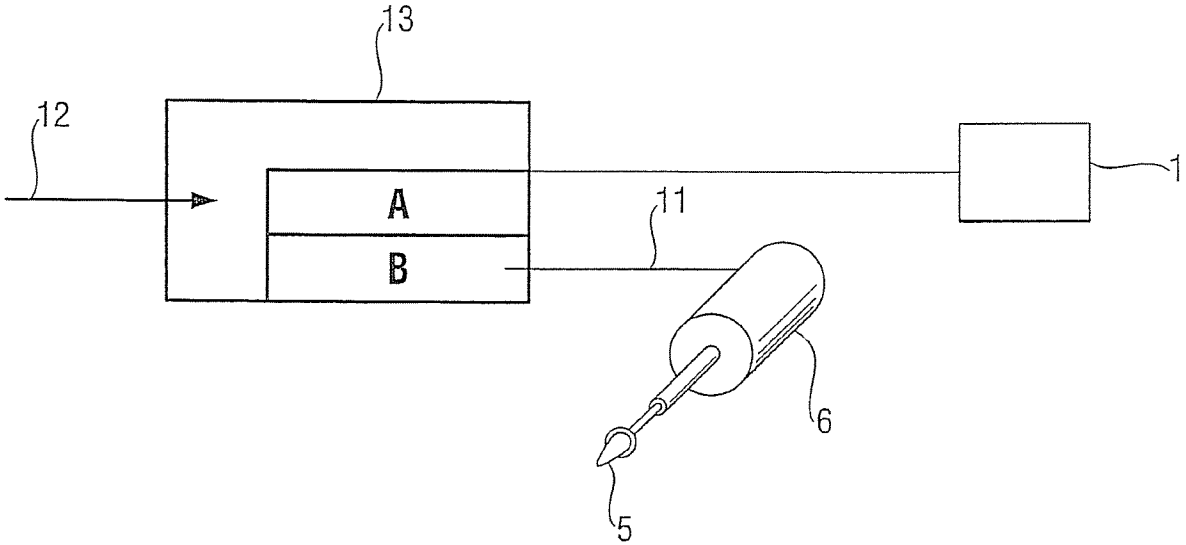
FIG. 5 illustrates a schematic view of a control apparatus.

FIG. 5 depicts a schematic illustration of a circuit board 13 with a control apparatus 6 attached thereto and a radial fan 1. The circuit board 13 receives the data for the radial fan 1 through a bus 12, as well as the data for the control apparatus 6. Thus, the circuit board 13 is divided into components A and B, wherein the portion A is provided for the air volume flow regulation of the radial fan 1, and the portion B is provided for the driver of the control apparatus 6. Thus, the control apparatus 6 can be controlled electronically through the same bus 12 as the radial fan 1.

It is appreciated that all features of the particular embodiments can be combined with one another at will, as long as this is technically feasible and no contradiction is created. Thus, it is possible e.g. to provide a receiver for the control apparatus 6 according to FIG. 1 also in an embodiment according to FIG. 3.

What is claimed is:

1. A radial fan, in particular for a gas burner, for premixing air and gas, the radial fan comprising:

a housing with a radial fan wheel disposed therein, and a regulation valve for regulating a gas volume, the regulation valve comprising a valve seat, wherein the valve seat of the regulation valve is formed by a portion of the housing;

the regulation valve comprises a control apparatus regulating the gas volume;

an opening position of the regulation valve is adjusted to an optimum position for a subsequent operation of the gas burner while the radial fan is in a standby state; and the control apparatus is electronically controlled through a bus.

2. The radial fan according to claim 1, wherein the valve seat is configured in an interior of the housing.

3. The radial fan according to claim 1, wherein the valve seat is configured at an outer edge of the housing.

4. The radial fan according to claim 1, wherein the housing is made from die cast material.

5. The radial fan according to claim 1, wherein the regulation valve comprises a valve body.

6. The radial fan according to claim 5, wherein the valve body is a valve cone.

7. The radial fan according to claim 1, wherein the control apparatus is a stepper motor.

8. The radial fan according to claim 1, wherein an inlet cavity is configured between the control apparatus and the valve seat.

9. The radial fan according to claim 8, wherein the inlet cavity has a gas outlet towards the radial fan wheel.

10. The radial fan according to claim 9, wherein the gas outlet is configured as an annular gap.

11. The radial fan according to claim 1, wherein at least a portion of the regulation valve is disposed in a slotted tube.

12. The radial fan according to claim 1, wherein the control apparatus is disposed in an additional protective housing, disposed on the outside of the housing and sealed against gas leakage.

13. The radial fan according to claim 12, wherein the protective housing is made of cast material, die cast material or plastic material.

14. The radial fan according to claim 1, further comprising a seal disposed between an electric conductor to the control apparatus and the housing.

15. The radial fan according to claim 1, wherein the control of the radial fan or a control or regulation of the regulation valve is performed through a single circuit board.

16. The radial fan according to claim 1, wherein the control apparatus can be attached in the housing without fasteners.

17. The radial fan according to claim 1, wherein the housing is formed by two covers, enclosing a housing cavity, wherein the control apparatus is disposed between the covers.

18. The radial fan according to claim 1, wherein at least one safety apparatus against gas leakage is disposed outside of the housing or on the outside at the housing.

19. The radial fan according to claim 18, wherein the at least one safety apparatus against gas leakage is configured as at least one gas safety valve.

20. The radial fan according to claim 19, wherein the gas supply is disposed at the at least one gas safety valve.

21. The radial fan according to claim 1, wherein the opening position of the regulation valve is automatically adjusted in the standby state of the radial fan for the subsequent operating phase of the radial fan.

22. The radial fan according to claim 1, further comprising a gas supply line having a safety apparatus for safety against gas leakage outside of the housing.

* * * * *